United States Patent [19]

Svet

[11] 4,251,041

[45] Feb. 17, 1981

[54] MULTIPLEXING MEANS FOR MOTION DETECTORS AT GRADE CROSSINGS

[75] Inventor: Frank A. Svet, Churchville, N.Y.

[73] Assignee: General Signal Corporation, Stamford, Conn.

[21] Appl. No.: 923,851

[22] Filed: Jul. 12, 1978

[51] Int. Cl.[3] ..... B61L 1/02; B61L 21/06

[52] U.S. Cl. ..... 246/128; 246/125; 246/130

[58] Field of Search ..... 246/125, 128, 130, 221, 246/111, 114 R, 114 A, 118; 340/49, 121

[56] References Cited

U.S. PATENT DOCUMENTS

| | | | |
|---|---|---|---|
| 3,422,262 | 1/1969 | Brockman | 246/130 R |
| 3,781,542 | 12/1973 | Brockman | 246/125 |
| 3,781,543 | 12/1973 | Staples | 246/125 |
| 4,120,471 | 10/1978 | Auer | 246/128 |

*Primary Examiner*—Trygve M. Blix
*Assistant Examiner*—Reinhard J. Eisenzopf
*Attorney, Agent, or Firm*—Milton E. Kleinman; George W. Killian

[57] ABSTRACT

At a railroad crossing, a single motion detection unit is selectively coupled to an occupied track in such manner that safe, effective and efficient control is obtained over the crossing alarm device. The means for coupling the motion detection unit includes means for terminating the activation of the crossing alarm device when a train stops on the approach track, but short of the actual intersection. Techniques for multiplexing a motion detection unit with plural tracks at the grade crossing or with multiple track circuits on a single track are provided. Safe operation is assured with multiple track occupancy irrespective of the sequence of occupancy and which is the last to remain occupied or if one of the trains stops or reverses direction of motion.

26 Claims, 6 Drawing Figures

MULTIPLEXING MEANS FOR MOTION DETECTORS AT GRADE CROSSINGS

BACKGROUND OF THE INVENTION

1. Field of the Invention

Inevitably, railroad tracks and vehicular traffic roads have to cross each other at some locations. It is conventional to provide warning devices at such intersections in order to provide a signal to motorists indicating that a train is about to cross the intersection. The warning device has traditionally taken any of a rather wide variety of forms and may include one or more of flashing lights, audible alarms, and barriers. It has long been the practice to actuate such crossing alarm devices in automatic response to the presence of a train. Typically, a track circuit detects the entry of a train within the critical area and the crossing alarm device is actuated. However, this can cause an unnecessary actuation of the crossing alarm device if the train enters the area of the track circuit, but does not cross the road. This condition may occur when a train approaches an intersection, stops and/or reverses. This may occur as a result of a switching operation or any number of other circumstances with which those familiar with the railroading art are acquainted. A wide variety of sophisticated controls have been developed in order to avoid prolonged and unnecessary actuation of the crossing alarm device when a train is not crossing the road.

Devices known as motion detecting units, hereinafter sometimes identified as MDU, or DMU, have been designed which will detect approaching train motion and cause the crossing alarm device to be actuated only when there is actual train motion. While an MDU provides increased convenience in the actuation of the crossing alarm device, they are not always used due to the cost thereof. Consider for example a situation wherein several parallel tracks cross a highway. It would be necessary to provide an MDU for each set of tracks. Especially in applications wherein the road is a secondary road and/or the number of trains crossing per day is small, it has been considered too expensive to provide an MDU on each track. In such situations, alternate signal control methods may be used which, although more economical, sometimes result in actuating the alarm signal unnecessarily.

SUMMARY OF THE INVENTION

There is provided a technique for multiplexing a single motion detector unit (MDU) at a single or multitrack grade crossing so that the MDU may be associated with an appropriate one of a plurality of track circuits in response to the presence of a train. This provides space and cost savings and permits the addition of an MDU to grade crossing where the cost of a separate MDU for each track circuit could not be justified. If more than one track, or track circuit, is occupied simultaneously, the MDU is disconnected and the crossing alarm provided. When all but one train has left, or stopped, the MDU monitors the single track with a moving train and provides appropriate crossing alarm control. An island track circuit may be used to provide crossing alarm control when any train is in the island irrespective of motion of the train.

The system prevents unnecessary and prolonged crossing alarms when a train is parked near a grade crossing and/or during nearby reverse motion for switching, train makeup, or other reasons.

The techniques may also be used with a single track carrying two-way traffic to associate the MDU with either the east or west approach as may be appropriate.

It is an object of the present invention to provide a new and improved control circuit for a grade crossing alarm device.

It is another object of the invention to provide a new and improved circuit including a motion detector for controlling a grade crossing alarm device.

It is a more specific object of the invention to provide a circuit means for economically and efficiently employing a single motion detector at a grade crossing.

It is a more specific object of the invention to provide circuit means for switching a single motion detector so that it is associated with an appropriate track circuit in response to the presence of a train.

It is another object of the invention to control the railroad crossing alarm device so that unnecessary alarms are not provided when a train is parked in the vicinity of the grade crossing.

It is another object of the invention to provide suitable crossing alarm signals when two or more trains are in the vicinity of the grade crossing.

BRIEF DESCRIPTION OF THE DRAWING

The foregoing and other objects, features and advantages of the present invention will be more fully appreciated, by those skilled in the related arts, by considering the following detailed description of illustrative embodiments taken together with the drawing in which, FIGS. 1 and 2, when arranged as indicated in FIG. 2A, disclose a circuit using the invention as applied to a plurality of track circuits and, FIGS. 3 and 4, when arranged as illustrated in FIG. 4A, illustrate another embodiment of the invention as applied to a single track.

These figures represent circuit diagrams wherein selected elements have been given mnemonic designators to assist in understanding the function and purpose thereof. Relay contacts associated with a relay are arranged in vertical alignment with the relay and all contacts are shown in their idle or standby condition with power applied to the circuit and with no train present in the vicinity.

DESCRIPTION OF THE PREFERRED EMBODIMENTS

Figure 1:
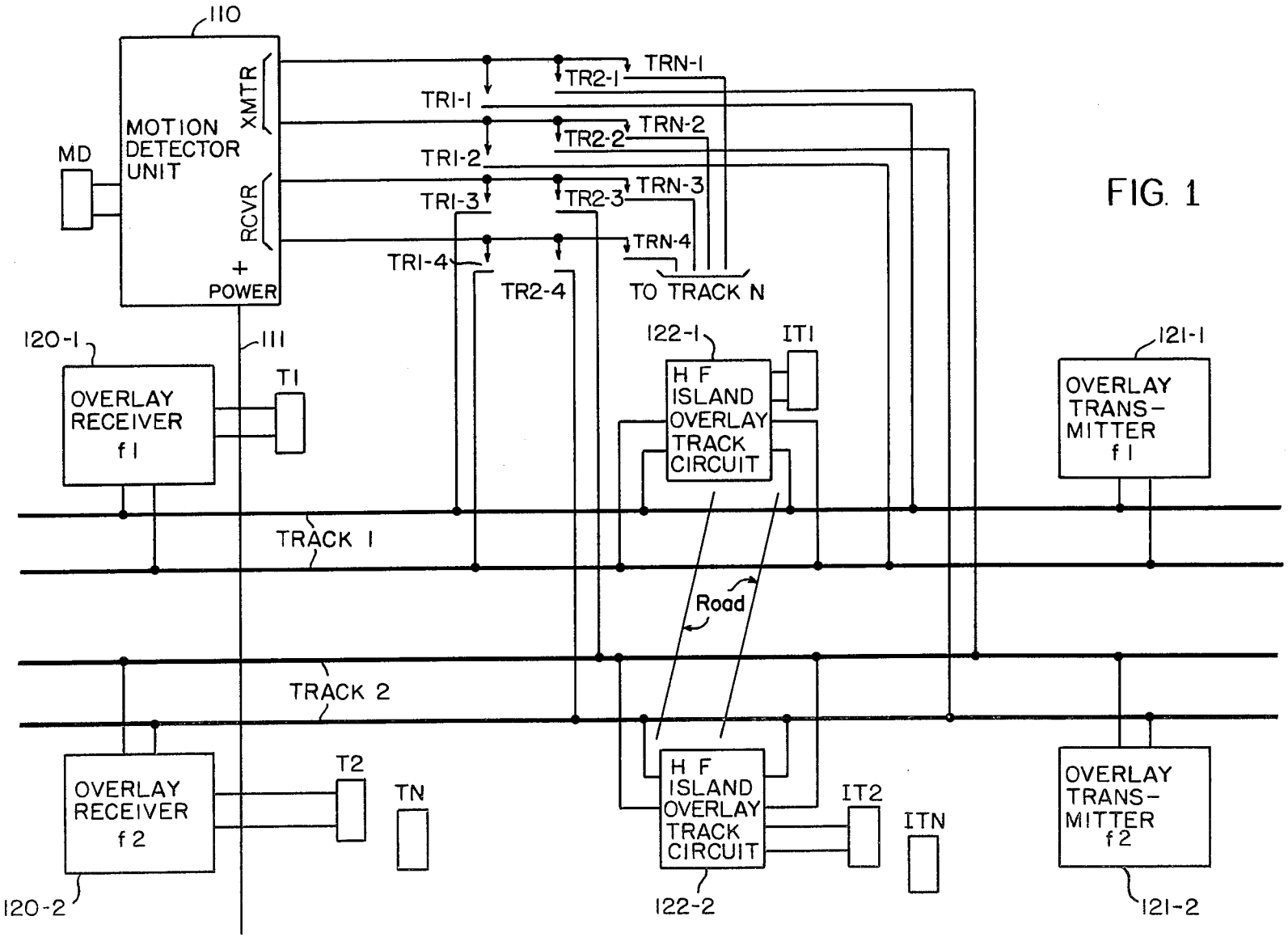
Figure 2:
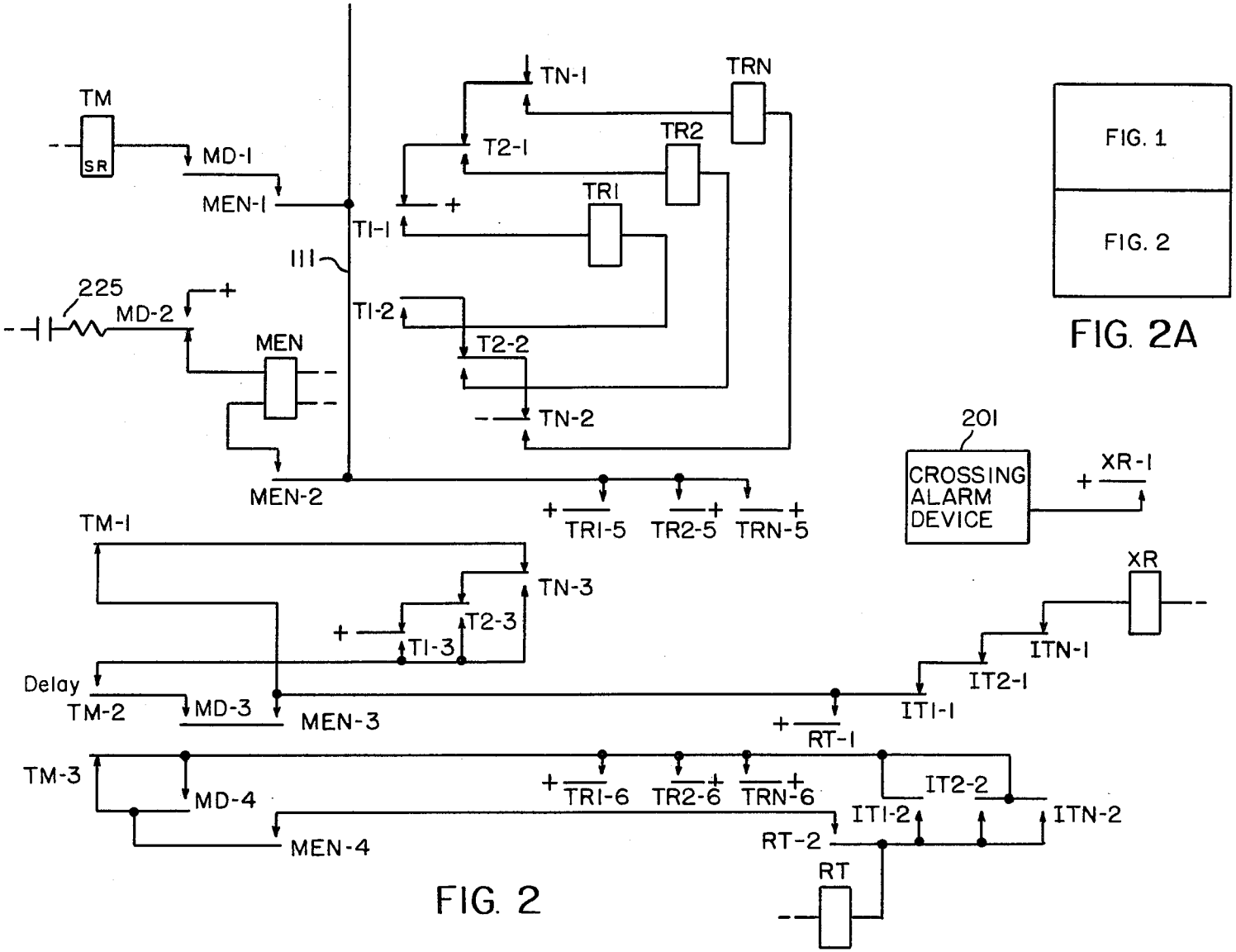

One implementation of the invention may be understood by considering FIGS. 1 and 2 when arranged together as illustrated in FIG. 2A. It will be recalled that an objective of the invention is to permit the use of a single motion detector unit with a plurality of tracks. FIG. 1 illustrates two parallel tracks designated TRACK 1 and TRACK 2. It should be understood that there may be additional tracks such as TRACK 3, TRACK 4, TRACK N, etc. Connections and equipment associated with the additional tracks would be similar to that shown for TRACK 1 and TRACK 2. For the most part, FIGS. 1 and 2 will be discussed and described as a two-track system. However, selected and key elements of equipment associated with additional tracks are illustrated in order to show how the invention will function with more than two tracks.

Crossing TRACK 1 and TRACK 2 is a road designated ROAD; positioned near the ROAD and arranged to function for traffic in both directions on the ROAD is a crossing alarm device 201 shown in FIG. 2. The crossing alarm device 201 may include any combination of lights, bells, horns, and barrier, all as conventionally used in the art.

The circuit of FIGS. 1 and 2 includes several electromechanical relays. However, it should be understood that the invention is not limited to the use of relays and that a microprocessor or other solid state techniques could be used. In accordance with railroad circuit conventions, all contacts which are associated with a particular relay are arranged vertically above or below the rectangle representing the relay coil. Furthermore, in accordance with convention, the "swinger" of each contact should be considered as being in a lower position when the relay coil is not energized. That is, when a relay coil is not energized, the associated swingers will fall by the force of gravity to a downward position. This is a pictorial representation of a physical design characteristic of the relay; and relays which will reliably function in this manner are frequently designated vital relays. Examination of the drawing will reveal that selected swingers are drawn in their upward position. For example, see relays T1, T2, TN, IT1, IT2, ITN and XR. This indicates that these relays are normally operated relays. That is, these relays will be electrically energized under normal conditions with no train present.

The motion detector unit which is to be multiplexed to TRACK 1 or TRACK 2 or any other tracks which may be provided is shown as element 110 in FIG. 1. The motion detector 110 has an associated motion detector relay designated MD which will be released whenever power is removed from the motion detector unit, hereinafter frequently referred to as the MDU, and the MDU will cause pickup of the MD relay upon application of power to the MDU. The motion detector unit 110 includes transmitter and receiver leads, and connections to the MDU may be made through the terminals designated XMTR and RCVR for transmitter and receiver, respectively.

The circuit of FIGS. 1 and 2 is actuated by a d.c. power supply and any element of the circuit which is to be connected to the positive or negative terminals of the d.c. power supply is designated "+" and "−", respectively. Thus all points which are connected to the positive potential of the power supply (not otherwise shown) are designated with a plus sign; and all terminals which are connected to the negative side of the power supply are designated with a minus sign.

The MDU 110 may be turned on by the application of positive potential to lead 111. As may be seen, the XMTR and RCVR terminals of the MDU 110 may be coupled to TRACK 1 and TRACK 2 by contacts on the TR1 and TR2 relays, respectively. In addition, the MDU may be connected to TRACK N by contacts on a TRN relay.

Further details concerning the structure and characteristic of the MDU 110 may be seen in the U.S. patent applications of John H. Auer, Jr. and Frank A. Svet et al, filed on June 21, 1977, and assigned Ser. Nos. 808,592 and 808,747 respectively. The earlier application issued on Oct. 17, 1978 as U.S. Pat. No. 4,120,471 and the latter filed application issued as U.S. Pat. No. 4,172,576 on Oct. 30, 1979. These applications are assigned to the same assignee as the present application.

Each track will be seen to include an overlay track circuit including an overlay receiver 120-1 and 120-2, for TRACKS 1 and 2, respectively. In a similar manner, an overlay transmitter 121-1 and 121-2 is provided for each track. As is conventional, a separate frequency is used for each track. In addition, each track has a separate high frequency island overlay track circuit 122-1 and 122-2, respectively. These components are widely used and well known to those skilled in applicable arts and are not described herein in detail as such description would unduly lengthen the specification and tend to obscure the inventive concept. Although a.c. track circuits are illustrated, it should be understood that the inventive concept to be described would function with equal convenience and economy in a system employing d.c. track circuits. Those familiar with track circuits will understand that when a train enters the area controlled by the track circuit, the presence of the train provides a shunt between the tracks which causes a relay to release or operate. In the illustrated example, relays T1 and T2 are actuated when trains are not on TRACKS 1 and 2, respectively. In a similar manner, an island track relay designated IT1 and IT2 for TRACKS 1 and 2, respectively, is released when the train enters the boundary of the island overlay track circuit.

In order to facilitate circuit analysis and comprehension, the relays have been given mnemonic designators. These mnemonic designators will be used throughout the specification rather than numerical designators. Contacts associated with a relay have been assigned a designator which is identical to the relay but include a suffix digit wherein the suffix digit is assigned in numeric order from top to bottom on the drawing.

In order to more fully appreciate the relay mnemonics and the function of each relay in the circuit, the general purpose or function of each relay will next be discussed.

T1, T2 and TN are track approach relays and are normally operated when there is no train on the track. This means that should the power fail, or the relay malfunction as from an open coil, the relay will release and provide an indication of the presence of a train on the track. This provides what is customarily termed "fail-safe" operation. That is, in the event of certain malfunctions, the equipment is designed in such manner that there can be no train present without an indication thereof. This does means that in the event of certain malfunctions, train presence may be indicated when, in fact, there is no train.

TR1, TR2 and TRN are relays which are, in effect, inverse slave relays of the T1, T2 and TN relays, respectively. It should be observed that the circuitry to the TR relays is such that only one can be operated at any given time irrespective of the fact that more than one of the T relays may be released at a given time. It will be seen that the TR relays have as a primary function coupling the MDU to the track with the TR1 relay connecting the MDU to TRACK 1, and TR2 relay connecting the MDU to TRACK 2 and so on. Since only one of the TR relays can be operated at a time, the MDU can only be connected to one track at a time.

MD is a motion detector relay associated with the MDU. The MD relay operates when energy is applied to the MDU and subsequently releases when the MDU detects approaching motion on the track. The MD relay will reoperate after a predetermined time delay, which may be adjusted, and which typically may be of the order of 30 to 90 seconds, if the MDU has not detected motion within that time interval.

MEN is a motion enable relay and operates to indicate that the MDU has seen approaching motion at least once subsequent to the energization of the MDU and its coupling to a track. The MEN relay alters the circuit to allow the MD relay to gain control over the XR relay.

IT1, IT2 and ITN relays are island track relays which function in a manner generally similar to the T1, T2 and TN relays. That is, these relays are normally operated when there is no train in the island and will release when there is a train in the island. It will be observed that these relays include contacts in series with the XR relay and that in response to the release of any one or more of the IT relays, the XR relay will be released.

XR is the crossing relay and is normally operated and, when operated, prevents the actuation of the crossing alarm device 201. When the XR relay releases, the crossing alarm device is activated. It will be seen that the crossing relay XR will be released whenever a train is in any of the island circuits.

TM is a timing relay sometimes referred to as the ring sustain timer. This relay is a slow release relay and is indicated as such by the letters SR in the symbol representing the coil of the relay. This relay has a special mechanical delay which causes the contacts TM-2 to be actuated much later than the other contacts. The timing may be of the order of 30 to 60 or 90 seconds. The period of time between the pick up of the MD relay, due to the absence of approaching train motion, and the pick up of the XR relay is referred to as the ring sustain time delay. This delay is vital to the safe operation of the system. The time may be adjusted in accordance with guidelines set forth in the above-identified application Ser. No. lines set forth in the above-identical application Ser. No. 808,592 and in accordance with the exigencies of the particular circumstances.

RT is the ring termination relay and, when actuated, will prevent actuation of the crossing alarm device provided no train is in any island track circuit.

The sequence of circuit operation as a train (not shown) approaches and crosses the ROAD will next be described. The description will describe the train as being on TRACK 1. However, it should be understood that the circuit actuation, if a train should approach on TRACK 2, is substantially identical except that selected relays associated with TRACK 2 will be actuated and/or released instead of selected relays associated with TRACK 1.

Selected relays are normally operated when there is no train on either TRACK 1 or TRACK 2 within the areas controlled by the circuits shown. The normally actuated relays are: T1, T2, TN, IT1, IT2, ITN and XR. All relay contacts are shown as they exist at this time with no train on the track. More specifically, the swingers for the normally operated relays are all shown in their upward position while the swingers for the normally released relays are shown in their downward position. Whenever a relay is released, all of its associated swingers move downward as viewed in FIGS. 1 and 2. The T1 relay is held operated because the overlay transmitter 121-1 applies a signal of frequency f1 to the rails of TRACK 1 and this signal is picked up by the overlay receiver 120-1 and in response to receipt of that signal, the overlay receiver 120-1 actuates the associated T1 relay. The T2 relay is actuated in substantially the same manner with a signal from overlay transmitter 121-2 applied to TRACK 2. If there are additional tracks, an overlay transmitter and receiver is associated with each track and a relay is associated with each overlay receiver. The TN relay is shown to illustrate the manner in which contacts associated with additional relays associated with overlay receivers would be wired into the circuits. In order to simplify the drawing, only TRACK 1 and TRACK 2 are illustrated. However, it should be understood that there could be additional tracks and additional T relays.

There is a high frequency island overlay track circuit 122-1 associated with TRACK 1 which functions in a manner similar to the overlay transmitter and receivers 121-1 and 120-1 and the high frequency island overlay track circuit 122-1 will maintain relay IT1 actuated so long as no train is on TRACK 1 within the limits defined by the island overlay track circuit which extends a little more than the width of the road. In a similar manner, the high frequency island overlay track circuit 122-2 maintains relay IT2 operated. If there are additional tracks, additional IT relays including ITN will be actuated.

The crossing relay XR is maintained actuated, with no train on the tracks, from negative power supply through the XR relay coil and normally actuated contacts of the ITN-1, IT2-1 and ITI-1 contacts in series and through released contact TM-1 and then normally operated contacts TN-3, T2-3 and T1-3 to the positive power supply. With the crossing relay XR actuated, the contacts XR-1 are held open and the crossing alarm device 201 is not actuated and therefore there is no signal near the road to inhibit vehicular traffic from driving along the road and crossing TRACKS 1 and 2 and/or other tracks, if included.

When a train approaches the road on TRACK 1, the train will apply a shunt between the rails of TRACK 1 and, in accordance with circuit techniques with which those familar with the art are well acquainted, this will diminish the signal received by the overlay receiver 120-1 and therefore the relay T1 will be released. All of the contacts associated with relay T1 will be released and these contacts are shown in vertical alignment with the coil of relay T1. It will be recalled that the crossing relay XR was held operated from the positive power supply at the swinger of relay contact T1-3. Accordingly, with relay T1 released, the swinger of contact T1-3 will move downward, thereby opening the circuit to the crossing relay XR. Release of the crossing relay XR will close the contacts XR-1 which will activate the crossing alarm device 201 thereby providing a signal to warn vehicular traffic of the approach of a train. The release of contact T1-1 will apply positive power to one side of the coil TR1 and the other side of the coil TR1 will be connected to the negative power supply through closed contact T1-2 and normally actuated contacts T2-2 and TN-2. Accordingly, the relay TR1 will be operated. Examination of the circuits of the TR1, TR2 and TRN relays will show that if only relay T1 is released, the TR1 may be operated; and if only the relay T2 is released, the relay TR2 may be operated; and if only the relay TN is released, the relay TRN may be operated. However, if more than one of the relays T1, T2 and TN are released, none of the relays TR1, TR2 and TRN can be operated. In summary, in response to the presence of a train on TRACK 1, and T1 relay is released, TR1 relay is actuated and the relay XR is released.

The operation of relay TR1 actuates all of the contacts associated with relay TR1 and the contacts TR1-1 through TR1-4 couple the motion detector unit 110 to TRACK 1. More specifically, a pair of leads from the motion detector unit 110 and designated XMTR (which stands for transmitter) is coupled to TRACK 1 on one side of the ROAD and the terminals RCVR (which stands for receiver) are coupled to TRACK 1 on the other side of the ROAD. When the motion detector unit, hereinafter usually referred to as MDU, is coupled to a track it is capable of detecting whether or not a train on that track is in motion towards the grade crossing. Devices with this capability are known in the art and will not be described herein in detail inasmuch as such description would only tend to obscure the inventive concepts described herein. Those desiring additional information about MDU's will find it in various reference works including the patent applications referenced hereinabove. It should be appreciated that a characteristic of the motion detector unit 110 is that it will cause the release of an associated motion detector relay MD when power is removed from the MDU and cause pickup of the same relay when power is applied to the MDU.

Contacts TR1-5, when closed by operation of the TR1 relay, will place positive potential on lead 111 and thereby apply positive potential to the MDU 110. In response to the application of power to the MDU 110, the MD relay will be operated. With the MD relay actuated, the contacts MD-2 will be actuated and the capacitor of the RC network 225 will be charged with power from the positive power supply through the now closed contacts MD-2 through the RC network 225 to the negative power supply. The remaining contacts on the MD relay do not cause the immediate actuation or release of any other relays. With the MDU now coupled on TRACK 1, it will determine if the train on TRACK 1 is in approaching motion. If approaching train motion is detected, the MD relay will be released. In response to the detection of approaching train motion, the MD relay releases thereby restoring contacts MD-2 to its released condition and the energy stored on the capacitor of the RC network 225 will actuate the motion enable relay MEN. As soon as the MEN relay actuates, its contacts MEN-2 locks the MEN relay actuated with the energy provided on lead 111 by contacts TR1-5. The actuation of the motion enable relay MEN provides a stored indication that motion has been detected on the track.

The operation of the motion enable relay MEN indicates that the MDU has seen motion at least once during the passage of the train on the track. It will be seen subsequently that the operation of the MEN relay allows the motion detector, and more specifically the MD relay, to gain control of the XR relay at least until such time as the train enters the island track circuit. The operation of the MEN relay verifies that the MD relay was capable of both operating and releasing.

The MD relay will remain released so long as the MDU detects approaching train motion.

It will be recalled that operation of the contacts T1-3 opened the circuit to the crossing relay XR. With the contacts MEN-3 closed and all the IT relays operated, it will be seen that there is a path to operate the crossing relay XR except for the fact that the contacts TM-2 and MD-3 are open. The present condition is that relay T1 has released, TR1 has operated, XR has released, MEN has operated and locked and the MD relay is released so long as the MDU continues to detect approaching train motion.

If the train which has been detected on TRACK 1 and whose motion has been detected by the MDU 110 should stop at some point short of the island overlay track circuit, the crossing alarm device 201 is turned off in the following manner. The failure of the MDU to continue to detect train motion will cause the MD relay to reoperate. With the MD relay reoperated, the MD-1 contacts close to complete a path from positive potential at contact TR1-5 through lead 111, contacts MEN-1 and MD-1 to the Timer TM. The timer TM is sometimes referred to as a ring sustain timer as it allows the continued ringing, or actuation of the crossing alarm device 201, for predetermined period of time subsequent to the non-detection of approaching train motion. That is, the crossing alarm device, which is controlled by relay XR, is maintained in the alarm position for at least a predetermined period of time after the signal has been received indicating the train has stopped in order to permit further checking to ascertain that the train has, in fact, stopped and that the lack of motion detection is not the result of some circuit aberration. The operation of the timer TM may be most readily understood by considering it as a cam actuated device which actuates contacts TM-1 and TM-3 very soon after energization of the TM coil but which does not actuate contacts TM-2 for a predetermined interval which may be adjusted to close approximately 30 to 90 seconds after the energization of the TM coil. At the end of this timing interval, the contacts TM-2 will close provided the MD relay has not been released during this interval. When the contacts TM-2 close, the XR relay is operated over the circuit previously mentioned. More specifically, the XR relay is reactuated from negative potential on one side of the coil and positive potential at released contacts T1-3 through operated contacts TM-2, MD-3, MEN-3 and normally operated contacts IT1-1, IT2-1, and ITN-1 to the XR relay. With the XR relay operated, the contacts XR-1 are opened and the crossing alarm device 201 is deactivated thereby indicating that it is safe for vehicular traffic to pass on the road over the tracks. The period of delay between the actuation of the TM coil and the closure of the contacts TM-2 will depend on a wide variety of circumstances including possible train speed, the limits of the track circuits and other factors with which which are explained in the cited patent applications.

With the train stopped on the track, the following conditions prevail. Relay T1 is relased, relay TR1 is operated, and relays IT1 through ITN are operated, the MEN relay is up and locked, the MD relay is operated (as long as approaching motion is not detected) and the timing relay is operated. The XR relay has been operated and the crossing alarm device is turned off indicating it is safe for vehicular traffic to cross the railroad tracks.

If the stopped train on TRACK 1 resumes motion, such motion will be detected by the MDU and the MD relay will be released. Release of the MD relay opens contacts MD-3 which opens the circuit to the crossing relay XR thereby releasing contacts XR-1 and reactivating the crossing alarm device 201. In addition, the release of the MD relay will open contacts MD-1 thereby opening the circuit to the timer TM. Opening the circuit to the timer will cause contacts TM-1 and TM-3 to reclose and contacts TM-2 to open.

If the train has resumed motion in the forward direction, the train will eventually reach the island overlay track circuit and when the train enters the boundaries of the island overlay track circuit, the IT1 relay will be released thereby opening the circuit to the XR relay so that it cannot be actuated irrespective of the condition of either the MD or TM relays. That is, when the train is in the island track circuit, the actuation of the crossing alarm device 201 is independent of the detection of train motion. In response to the release of relay IT1, the contacts IT1-2 will close thereby providing a circuit for actuating the ring termination relay RT with positive potential from the operated contacts of TR1-6 through the released contacts of IT1-2 to the coil of the RT relay. As soon as the RT relay is actuated, it locks operated through its own contacts RT-2 and operated contacts MEN-4 and either released contacts TM-3 or operated contacts MD-4 to the positive power supply at contacts TR1-6.

As the train continues its motion, or stops and reverses direction, it will eventually leave the island track circuit and thereby allow the IT1 relay to reoperate. As soon as the IT-1 relay reoperates, the XR relay is operated from positive power supply at operated contacts RT-1 through the operated contacts of IT-1, IT2-1, and ITN-1. With the crossing relay energized, the crossing alarm device 201 is deenergized thereby providing a signal that vehicular traffic may proceed on the road and cross the tracks. Note that the crossing alarm device 201 has been deactivated in response to the train leaving the island track circuit and irrespective of the fact that the relay T1 is released and the MDU may be indicating train motion.

As the train departs away from the road, the MDU will not detect approaching train motion and hence the MD relay will be operated. Operation of the MD relay closes contacts MD-1 to reclose the circuit to the timer TM. Energizing the timer TM opens contacts TM-3 but inasmuch as the contacts MD-4 are in parallel therewith, the holding circuit for the RT relay is not disturbed. The timer TM runs as previously described but does not exercise any control over the crossing relay XR which is maintained operated by contacts RT-1. After the previously described delay time, the contacts TM-2 will close but they do not initiate any further action. In the normal course of events, the train might be presumed to continue and leave the area wherein its presence is detected by the overlay receiver 120-1 and thereby allow the operation of relay T1 which would cause the release of relay TR1 which in turn would release the RT and MEN relays. The XR relay would remain operated over the path first described which maintained the XR relay operated prior to the presence of a train.

Should the train pass through the island overlay track circuit and stop and reverse direction prior to the time that the relay T1 is reoperated, the MD relay will release when approaching train motion is again detected. Release of the MD relay will open the contacts MD-1 which will open the circuit to the timer TM. However, it should be observed that the timer incorporates a slow release feature, as indicated by the designation SR in the rectangle for the timer TM. Accordingly, for at least the slow release interval of the timer TM, the contacts MD-4 and TM-3 are both open and therefore the circuit to the RT relay is opened and it will release. With relay RT released, the contacts RT-1 opens the circuit to the XR relay and it releases. With the XR relay released, the contacts XR-1 close thereby reactivating the crossing alarm device 201.

Any subsequent motion of the train either forward or backward will cause the operations already described to be repeated.

It should be understood that the description given with respect to a train on TRACK 1 is also applicable for a train on TRACK 2 except that track relay T2 is released instead of track relay T1 and the motion detector is connected to TRACK 2 via the contacts of the TR2 relay. In this manner, it is possible to multiplex the MDU 110 to two or more tracks as may be required.

MULTIPLE TRAINS IN INTERSECTION

Obviously, a single MDU cannot be coupled to more than one track at a time and therefore if more than one track is simultaneously occupied a priority scheme must be established. In normal operation, one train will enter the zone first and the MDU will be associated with that track in the manner previously described. However, as soon as another train enters the zone on another track, it will be detected by the overlay receiver and the associated T relay will operate. For purposes of this discussion, it will be assumed that TRACKS 1 and 2 are both occupied and that therefore relay T1 and T2 will both be released. However, it should be understood that the two occupied tracks could be any combination of the tracks or that more than two tracks might be occupied. Examination of the circuit of FIG. 2 and more specifically the circuit to the relays TR1, TR2 and TRN will make it evident that when more than one of the relays T1, T2 or TN have been released, none of the TR1, TR2 or TRN relays can be operated. Accordingly, when T1 and T2 are both released, the contacts TR1-5, TR2-5 and TRN-5 will not be operated and a positive potential cannot be applied to lead 111 and therefore the MDU 110 will not be activated. Thus, when two or more tracks are occupied, the MDU does not function in the manner previously described and, in fact, has no function. That is, if positive potential is not applied to lead 111 the MDU is disconnected and remains idle.

With the MDU idle, the MD relay will never be operated and therefore contacts MD-1 will never close and the timing relay TM will not be activated. Also, since the MD relay is never operated, the contact MD-2 does not operate and the capacitor of the RC network does not become charged and MEN relay will not be operated. Since the TR1, TR2 and TRN relays will all remain released, the RT relay will never operate inasmuch as operation of the RT relay depends on the closure of one of the contacts TR1-6, TR2-6 or TRN-6.

In summary, when two or more trains are sensed on the tracks, two of the T relays release and none of the TR relays operate and under these conditions, the relays MD, TM, MEN and RT cannot be activated.

Release of the T relay associated with the first track to be occupied releases the crossing relay XR in the manner previously described with a single train approaching the intersection. Inasmuch as the TM, MD and MEN relays cannot be operated when there are multiple trains at the intersection, it will be evident that the crossing relay XR will not be reoperated so long as the described conditions prevail. With the crossing relay released, the crossing alarm device 201 is activated and remains activated so long as two or more tracks show simultaneous occupancy.

Joint occupancy of tracks may occur in any of a variety of ways. For example, joint occupancy may occur with two through trains in the same or opposite directions; or joint occupancy may occur while one train is parked or switching and a second through train comes on the other track. It might also happen that the first train to be detected on one of the tracks is either the first or last train to leave.

In any of these cases, the first train to be detected causes the MDU to be associated with the track on which the train is detected. As soon as the second train is detected, the MDU is released and the crossing alarm device remains actuated as long as there is joint occupancy. When any of the trains leave the intersection and only one T relay remains released, the system recovers in a vital manner and watches for train motion on the occupied track. This is true regardless of which train enters the intersection first and/or which train is the last to remain. For example, if a train enters TRACK 1 and is detected and stops, it controls the crossing alarm device 201 in the manner given in the previous description for a single train. If, however, a second train enters on an adjoining track and stops, the crossing alarm device 201 flashes continuously as soon as the second train is detected by the release of the associated T relay. If the first train subsequently leaves the approach track circuit, the MDU is turned on as only a single T relay is operated, but is now applied to the second track and the MDU will be sensitive to motion of the train on the second track. The crossing relay XR remains released, that is, it is controlled by the approach track relay associated with the second train until the second train moves and motion is detected resulting in an operation of the MEN relay. Thus, the system logic requires new verification of the motion detector's capability of detecting motion subsequent to any joint track occupancy even if the same train that initially proved its presence to the motion detector remains in the intersection. From the above, it will be seen that all system memory is cleared in response to joint occupancy and starts afresh when a single train remains in the intersection irrespective of whether the remaining train was the first to enter the intersection.

Figure 3:
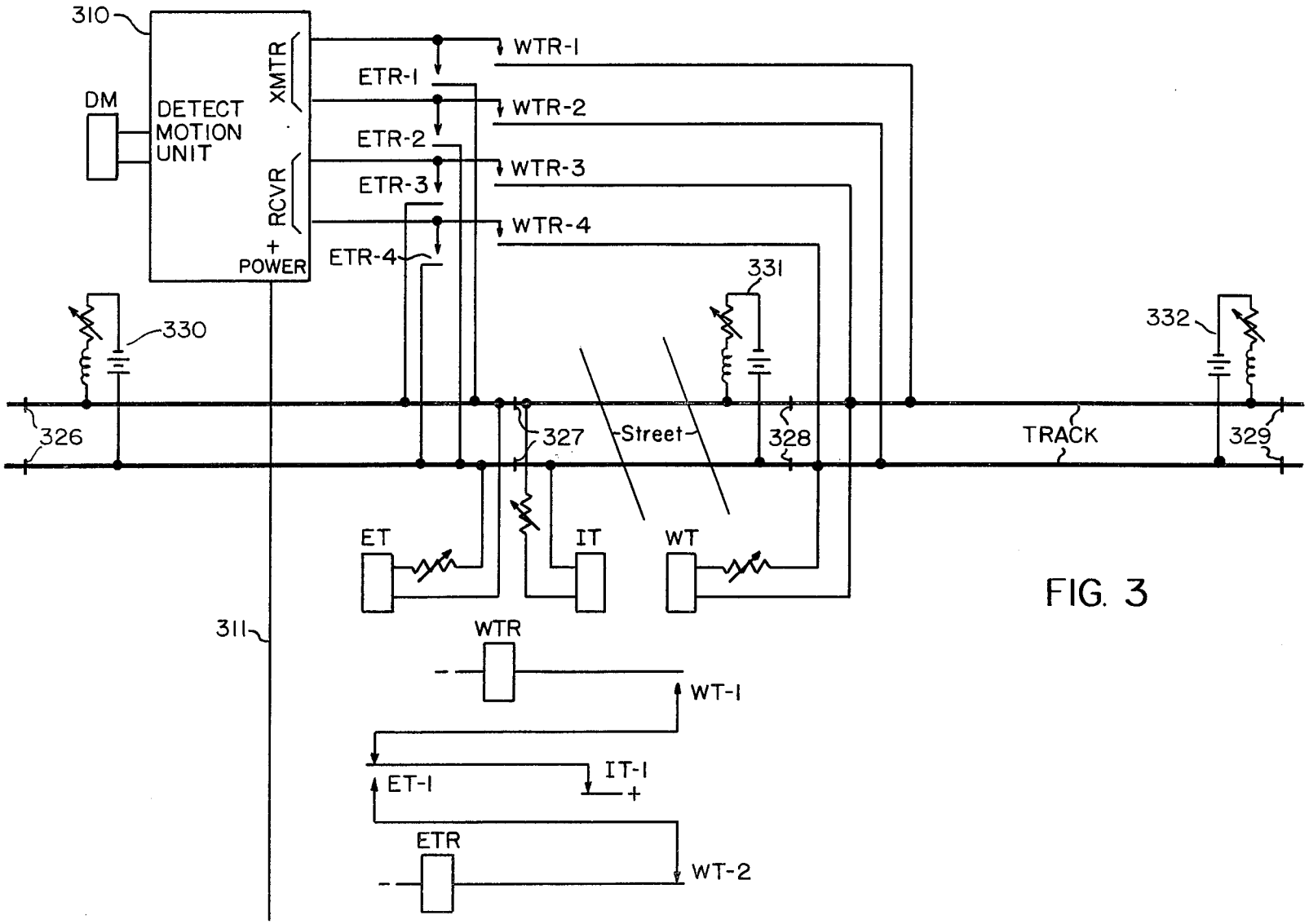
Figure 4A:
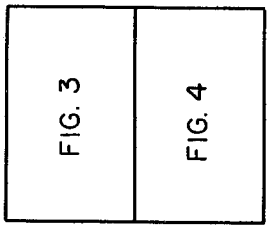
Figure 4:
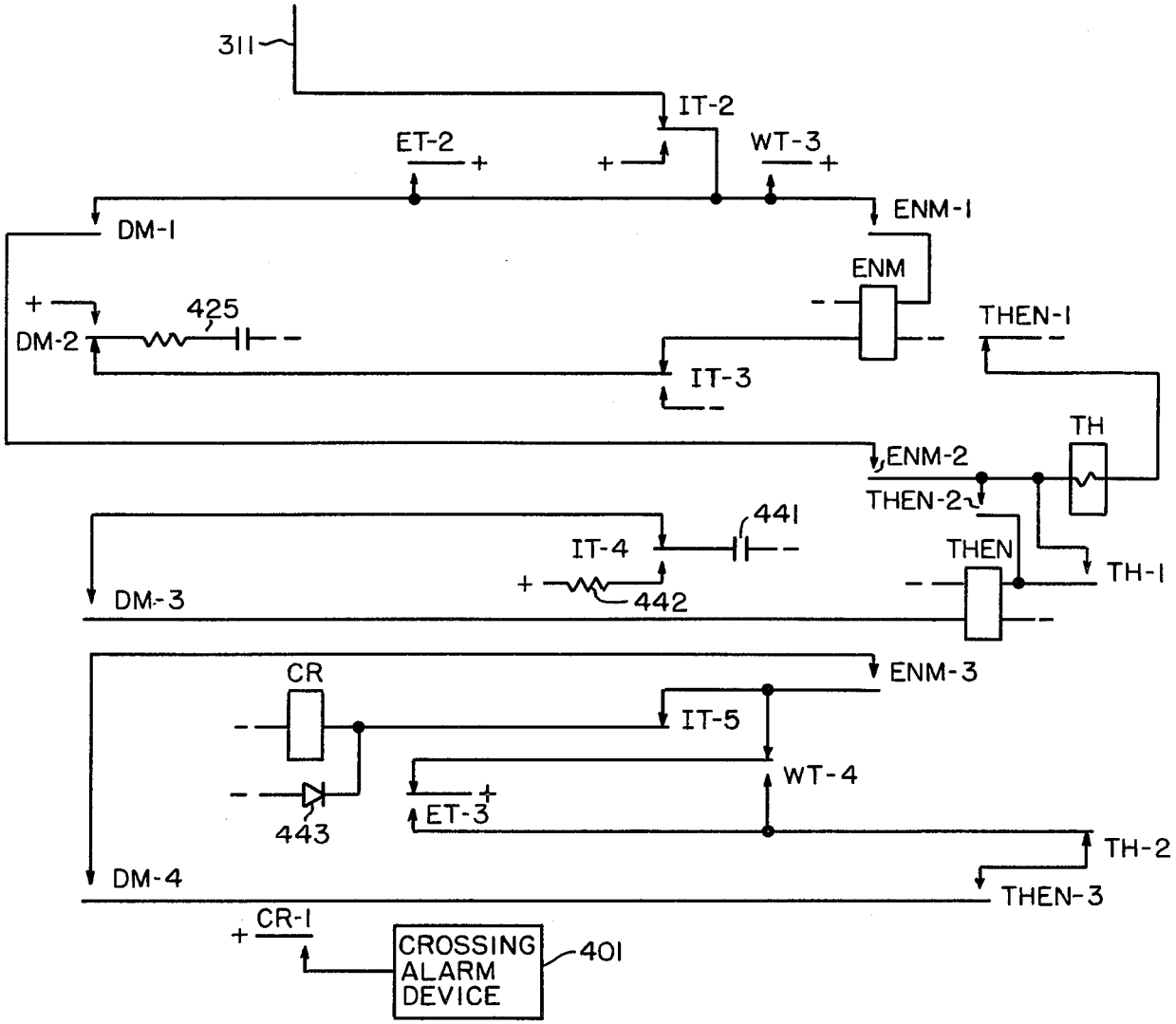

Multiplexed Motion Detector on a Grade Crossing Containing Multiple Separated Track Sections Another implementation of the invention is disclosed in FIGS. 3 and 4 when arranged together as illustrated in FIG. 4A. In this illustration, a railroad track is designated TRACK. The TRACK of FIG. 3 is electrically separated into three isolated track circuits which, in this example, are d.c. in nature. More specifically, each track circuit is isolated by insulated joints 326, 327, 328 and 329, thus there is a first track circuit between insulated joints 326 and 327; a second track circuit between 327 and 328; and a third track circuit between insulated joints 328 and 329. The first track circuit includes circuit means 330 coupled at one end of the track near insulated joints 326. The circuit means 330 includes a d.c. power supply. At the remote end of this track section coupled to the track near insulated joints 327 is a relay ET which is normally operated. In a similar manner, circuit means 331, including a power source, is coupled to the track near the insulated joint 328 and maintains the relay IT normally operated. And in like fashion, circuit means 332 which includes a power source is coupled to the track near insulated joints 329 and maintains relay WT, which is coupled to the tracks near insulated joints 328, normally operated.

There is also provided a unit 310 for detecting motion which may be selectively coupled to the track section between insulated joints 326 and 327; or the track section between insulated joints 328 and 329. Since a motion detector depends on electrically continuous track throughout its sphere of influence, either two motion detectors, or a means of electrically coupling a motion detector around the insulated joints without coupling the track circuit energy, would normally be required. A duplicate motion detector system is, of course, expensive. An electrical joint bypass, though possible, would be difficult to implement especially if alternating current track circuits were employed instead of direct current track circuits as shown in FIG. 3.

A comparison of the circuit configuration of FIGS. 1 and 2 with that of FIGS. 3 and 4 will reveal that there are numerous similarities. A primary difference is that FIG. 3 illustrates a single track, whereas FIG. 1 illustrates two or more tracks. In FIG. 1, the MDU 110 was selectively coupled to one of the plurality of tracks. In FIG. 3, it will be seen that the unit 310 for detecting motion may be selectively coupled to one or another of selected portions of the same track. Crossing the track of FIG. 3 is a street designated STREET. In order to protect motorists travelling on this street, a crossing alarm device 401 is provided which functions in a manner similar to the crossing alarm device 201. That is, the crossing alarm device 401 may include any combination of audible, visual and physical warnings to indicate to a motorist travelling on the street that a train is in or approaching the intersection of the street and track.

The circuit of FIGS. 3 and 4 includes several electromechanical relays. However, it should be understood that the invention is not limited to the use of relays and that a microprocessor or other solid state techniques could be used. In accordance with railroad circuit convention, all contacts which are associated with a particular relay are arranged vertically above or below the rectangle representing the relay coil. Furthermore, in accordance with convention, the "swinger" of each contact should be considered as being in a lower position when the relay coil is not energized. That is, when a relay coil is not energized, the associated swingers will fall by the force of gravity to a downward position. This is a pictorial representation of a physical design characteristic of the relay; and relays which will reliably function in this manner are frequently designated vital relays. Examination of the drawing will reveal that selected swingers are drawn in their upward position. For example, see relays ET, IT, WT and CR. This indicates that these relays are normally operated relays. That is, these relays will be electrically energized under normal conditions with no trains present. Other conventions and symbolism as used in FIGS. 1 and 2 are incorporated in FIGS. 3 and 4. As in the case of FIGS. 1 and 2, the relays have been given mnemonic designators to facilitate circuit analysis and comprehension. These mnemonic designators will be used throughout the specifications rather than numerical designators. However, to avoid confusion with similar mnemonic designators in FIGS. 1 and 2, minor changes have been made. For example, the MDU 110 of FIG. 1 corresponds with the DMU 310 of FIG. 3. In like manner, the relays MEN, XR and MD of FIGS. 1 and 2 correspond in basic function with relays ENM, CR and DM of FIGS. 3 and 4. Therefore, with respect to these elements, reference may be had to the foregoing portion of the specification for an explanation of their general function. As with FIGS. 1 and 2, the contacts of FIGS. 3 and 4 which are associated with a relay have been assigned a designator which is identical to the relay mnemonic and with a suffix digit wherein the suffix digit is assigned in numeric order from top to bottom on the drawing.

In order to more fully appreciate the relay mnemonics, the function of each relay in the circuit will be discussed.

ET, WT and IT are track approach relays and are normally operated when there is no train within the limits of the track section between the insulated joints 326 through 329 between which the track approach relays are coupled. Thus, these relays are similar in nature and function to the relays T1, T2, TN, IT1, IT2 and ITN. The IT relay is the island track relay; the ET relay is the east approach track relay and the WT relay is the west approach track relay.

ETR and WTR are relays which are, in effect, inverse slave relays of the ET and WT relays, respectively. Accordingly, the ETR and WTR relays correspond with the TR1, TR2 and TRN relays of FIGS. 1 and 2. It will be observed that only one of the ETR and WTR relays can be operated at any given time and neither will operate if both the ET and WT relays are released; or if the IT relay is released.

TH is a thermal relay which is illustrated in FIG. 4 by the resistive element shown within the rectangle representing the operating element of the TH relay. The TH relay may be adjusted to operate within the range of approximately 30 to 90 seconds subsequent to the application of power. When power is removed from the TH relay, the heater must cool for a period of time before the contacts thereof restore to their normal condition. It will be seen that this relay corresponds in several respects with the TM relay of FIGS. 1 and 2.

THEN is the thermal enable relay which is enabled to operate in response to the operation of the TH relay.

Additional details concerning the function or purpose of these relays may be obtained by reviewing the portion of the foregoing specification which relates to the analogous relays of FIGS. 1 and 2.

The sequence of circuit operation as a train (not shown) approaches and crosses the STREET will next be described. The description will describe the train as a west bound train; that is, as a train traveling from right to left on the TRACK as seen in FIG. 3. However, it should be understood that the circuit actuation, if the train is east bound, is substantially identical except that the ET and WT relays change functions as also do the WTR and ETR relays.

Selected relays are normally operated when there is no train on the track between insulated joints 326 and 329. The normally actuated relays are: ET, IT, WT and CR. All relay contacts are shown as they exist at this time with no train on the track. More specifically, the swingers for the normally operated relays are all shown in their upward position while the swingers for the normally released relays are shown in their downward position. Whenever a relay is released, all of its associated swingers move downward as viewed in FIGS. 3 and 4. The ET, IT and WT relays are held operated in their respective track circuits by the power from the circuit means 330, 331 and 332. The crossing relay CR is maintained actuated, with no train on the track, from negative power supply through the CR relay coil and normally actuated contacts IT-5, WT-4 and ET-3 to the positive power supply. With the crossing relay CR actuated, the conacts CR-1 are held open and the crossing alarm device 401 is not actuated and therefore there is no signal near the STREET to inhibit vehicular traffic from driving along the street and crossing the track.

When the west bound train on the TRACK passes the insulated joint 329, a shunt is applied between the rails of the TRACK. In accordance with circuit techniques with which those familiar with the art are well acquainted, the shunt will diminish the current in the relay WT and therefore the WT relay will be released. It will be recalled that the crossing relay CR was held operated through the normally operated contacts WT-4. Accordingly, with WT released, the swinger of contact WT-4 will move downward, thereby opening the circuit to the crossing relay CR. Release of the crossing relay CR will close the contact CR-1 which will activate the crossing alarm device 401, thereby providing a signal to warn vehicular traffic of the approach of a train. The release of the relay WT will cause closure of the contacts WT-1 which will complete a circuit from the negative power supply to the relay coil WTR, the closed contacts WT-1 and the normally operated contacts ET-1 and IT-1 to the positive power supply. Accordingly, the relay WTR will be operated. It should be observed that the circuit configuration is such that WTR and ETR cannot be simultaneously operated and neither will be operated when the IT relay is released. In summary, in response to the westbound train crossing the insulated joints 329, the WT relay is released, the WTR relay is actuated and the CR relay is released.

The operation of the WTR relay actuates all of the contacts associated with the WTR relay and the contacts WTR-1 through WTR-4, couple the detect motion unit 310 to the track section between insulated joints 328 and 329. More specifically, a pair of leads from the detect motion unit (hereinafter usually DMU) and which pair of leads are designated XMTR (which stands for transmitter) and a pair of leads coupled to the terminals RCVR (which stands for receiver) is coupled to the track between insulated joints 328 and 329. When the DMU 310 is coupled to a track, it is capable of detecting whether or not a train on that track is approaching the grade intersection. The DMU has the characteristics previously set forth with respect to the MDU 110. In addition, the DMU 310 distinguishes between train motion approaching the STREET and train motion receding from the STREET. That is, if the train is departig from the grade intersection, there is no need to provide a crossing alarm. The distinction between approaching and departing motion is made by an impedance measurement responsive to train motion all in the manner described in the aforementioned patent applications.

Contacts WT-3 apply positive potential through normally operated contacts IT-2 to lead 311 and the positive power input terminal of the DMU 310. In response to this application of power to the DMU, the DM relay will be actuated. Thereafter, if motion is detected by the DMU, the DM relay will release. The closure of contact DM-2 will cause the capacitor of the RC circuit 425 to be charged to the system supply voltage.

When approaching train motion is detected, the DM relay releases and the energy stored on the capacitor of the RC network 415 passes through now released contact DM-2 and operated contacts IT-3 to operate the ENM relay. The ENM relay locks through its own contact ENM-1 to the positive power supply at closed contacts WT-3. The operation of the ENM relay indicates that the DMU has seen motion at least once during the passage of the current train. This permits the DMU to gain control over the crossing relay CR. The operation of the ENM relay shows that the DM relay is capable of operating and releasing.

If the west bound train approaching the intersection stops on the approach before reaching the island track circuit, between insulated joints 327 and 328, the crossing alarm device 401 is turned off in the manner to be described. The absence of the approaching train motion allows the DM relay to reoperate thereby closing contacts DM-1 which completes the circuit from the positive power supply at released contacts WT-3 through the now closed DM-1 contacts and the operated contacts ENM-2 to the thermal relay TH and the negative power supply at normally closed contacts THEN-1. The heater of the thermal relay TH starts to heat and when it is sufficiently warm, the associated contacts are operated. When TH operates the same positive power supply which energized TH passes through closed contacts TH-1 to operate the THEN relay. THEN, when operated, locks itself operated through contacts THEN-2, ENM-2 and DM-1, to the positive power supply at released contacts WT-3. The operation of the THEN relay opens contacts THEN-1 which removes energy from the heater of the TH relay causing it to begin to cool and in due course its contacts release. The sum of the operate and release time of the TH relay is an interval of the order of 30 to 90 seconds. When the TH-2 contacts release and close, there is a circuit for operating the crossing relay CR from the negative power supply through the CR coil, normally actuated contacts IT-5, operated contacts ENM-3, operated contacts DM-4, operated contacts THEN-3, released contacts TH-2, released contacts WT-4 to the positive power supply at normally operated contacts ET-3. With the crossing relay CR operated, the crossing alarm device 401 is turned off. Accordingly, the crossing alarm is turned off when the train stops short of the island circuit. The period of time between the operation of the DM relay, due to the cessation of approaching train motion, and the actuation of the crossing relay CR is referred to as the ring sustain time delay. This time delay is vital to the safe operation of the DMU. The time may be adjusted in accordance with the various requirements of the circuit and/or operating conditions.

With the west bound train stopped and having not yet entered the island track circuit between insulated joints 327 and 328, the relays which are operated are: DM, WTR, IT, ENM, THEN and CR.

When the stopped west bound train resumes motion towards the crossing, the DM relay will release when approaching motion is detected. The release of the DM relay opens contacts DM-4 to release the crossing relay CR and reactivate the crossing alarm device 401 to provide a warning to motorists at the grade intersection. The opening of contacts DM-1 opens the circuit to the THEN relay causing it to release.

The relays operated with the west bound train in motion but not yet having entered the island track circuit between insulated joints 327 and 328 are: ET, WTR, IT and ENM.

When the west bound train resumes motion, or continues motion, as the case may be, it will eventually enter the island track circuit between the insulated joints 327 and 328 which will cause the IT relay to release in the well known manner. Release of the IT relay will release the contacts IT-4 and cause the capacitor 441 to charge in series with the resistor 442. With contact IT-5 open, the circuit to the crossing relay CR is opened and therefore as long as the train is in the island circuit the crossing relay CR cannot be actuated to turn off the crossing alarm device 401. This assures crossing alarm protection independent of train motion as long as the train is in the island. Furthermore, the release of contacts IT-2 removes power from the DMU and the release of the IT-1 contacts opens the circuit to the WTR relay so that neither the WTR nor the ETR relays may be operated. By this action the DMU is turned off and disconnected entirely from the track. This disconnect is ETR relay operated, the contacts ETR-1 through ETR-4 will close to connect the DMU to the west section of the track between joints 326 and 327. With power connected to the DMU 310, the the DM relay will be operated closing contacts DM-3. When the IT relay reoperates and contacts IT-4 close, the energy stored on capacitor 441 will discharge through operated contacts DM-3 to operate the THEN relay. The THEN relay then locks itself operated through its other winding and operated contacts THEN-2, ENM-2 and DM-1 to positive potential at released contacts ET-2. The THEN relay opens contacts THEN-1, thereby preventing actuation of the thermal relay TH. Now that the train has left the island track circuit, vehicular traffic should be allowed to cross the track on the STREET. Operation of the THEN-3 contacts completes a circuit from positive potential at released contacts ET-3 through released contacts TH-2, operated contacts THEN-3, operated contacts DM-4, ENM-3 and IT-5 to the crossing relay CR. Actuation of the crossing relay CR operates and opens contacts CR-1 to disconnect the crossing alarm device 401 thereby indicating it is safe for vehicular traffic to cross the TRACK at the grade intersection.

If a train which is receding from the intersection should stop and reverse its direction towards the intersection, the crossing will again become protected. Since the train is approaching the intersection, the DMU will respond to the approaching motion and cause the release of the DM relay. Release of the DM relay will open contacts DM-4 which will open the circuit to the crossing relay CR thereby closing contacts CR-1 and activating the crossing alarm device 401. In addition, the opening of contact DM-1 opens the holding circuit to the THEN relay, thereby releasing it. The relays are now in the same state as they were when the train motion was originally detected on the approach. Any subsequent train operations, such as it stopping or passing through the island circuit will reinitiate the operations previously described.

When the west bound departing train has the last car pass the joints 326 the ET relay will again be energized. Actuation of the contacts ET-2 will break the circuit to the THEN relay and will alter the circuit to the crossing relay CR. That is, the CR relay will be held operated from normally operated contacts of ET-3 instead of the released contacts of ET-3. The diode 443 around the coil of the CR relay maintains the energized state of the CR relay to cover the transfer time of the ET-3 contacts. The actuation of the ET relay also opens the circuit to the ENM relay, which releases. Positive potential is also removed from lead 311, thereby deenergizing the DMU. The ETR relay releases in response to the reactivation of the ET-1 contacts and the DMU is disconnected from the track. The relays and contacts are now in the standby condition, as shown in FIGS. 3 and 4.

Examination of the circuit for the crossing relay CR will show that if both of the ET and WT relays are released the CR relay is released and the crossing alarm 401 will be activated. Under such conditions, neither the ETR nor the WTR relays can be actuated and the DMU is not coupled to the track. Obviously, it would be improper to have two trains approaching the intersection in opposite directions at the same time. However, both the east and west track circuits can be simultaneously occupied if, for example, a car is parked on one approach while switching cars to the other approach. The continuous activation of the crossing alarm device due to the joint occupancy of the two approaches will terminate as soon as one approach and the island becomes unoccupied. In such event, the motion detector would be switched to the occupied track section and the DM relay will be operated if the train is receding from the intersection or the DM relay will be released if the train is approaching the intersection.

In summary, there has been shown a technique for multiplexing a single motion detector unit to a plurality of tracks or to a plurality of track sections on a single track. As previously stated, the logic can be provided with relays, as illustrated, or with solid state means and the track circuits may be either a.c. or d.c. track circuits.

While there has been shown and described what is considered at present to be the preferred embodiments of the invention, modifications thereto will readily occur to those skilled in the related arts. For example, in another structure, different logic elements might be used or the sequence of relay contacts modified. It is believed that no further analysis or description is required and that the foregoing so fully reveals the gist of the present invention that those skilled in the applicable art can adapt it to meet the exigencies of their specific requirements. It is not desired, therefore, that the invention be limited to the embodiment shown and described, and it is intended to cover in the appended claims, all such modifications as fall within the true spirit and scope of the invention.

What is claimed is:

1. A control circuit for a highway crossing warning device at a grade crossing between a railroad track and a highway and comprising in combination:
   (a) first and second track circuits associated with respective track sections near the grade crossing with each track circuit being responsive to the presence of a train within the limits of the track section monitored by the track circuit;
   (b) first and second control means associated with said first and second track circuits, respectively, with each individually actuated in response to the entry of a train within the limits of the track section monitored by said first and second track circuits, respectively;
   (c) a single motion detection unit associated with said track circuits at the grade crossing; and
   (d) circuit means responsive to the actuation of one of said first and second control means for coupling said single motion detector unit to the track section whose track circuit has responded to the presence of a train whereby said motion detector unit can provide signals responsive to the detection of motion within the entered track section.

2. The combination as set forth in claim 1, wherein said first and second track circuits are associated with a single pair of track rails but on first and second sides of the grade crossing, respectively.

3. The combination as set forth in claim 2 and including control means responsive to periodic signals from said motion detector unit for actuating the highway crossing warning device.

4. The combination as set forth in claim 3 and including timing means coupled to said control means for terminating the actuation of the highway crossing warning device when the motion detector means does not detect train motion for a predetermined time interval.

5. The combination as set forth in claim 4 and including an island track circuit and wherein in response to the entry of the train within the limits of the island track circuit, the crossing warning device is actuated independent of signals from said motion detection unit.

6. The combination as set forth in claim 3, wherein the crossing warning device is actuated when said first and second track sections are jointly occupied.

7. The combination as set forth in claim 1, wherein said first and second track circuits are associated with first and second pairs of track rails, respectively, at the grade crossing.

8. The combination as set forth in claim 7 and including control means responsive to periodic signals from said motion detection unit for actuating the highway crossing warning device.

9. The combination as set forth in claim 8 and including timing means coupled to said control means for terminating the actuation of the highway crossing warning device when the motion detector unit does not detect train motion for a predetermined time interval.

10. The combination as set forth in claim 9 and including an island track circuit and wherein in response to the entry of the train within the limits of the track section associated with said island track circuit, the crossing warning device is actuated independent of signals from said motion detection unit.

11. The combination as set forth in claim 7, wherein the crossing warning device is actuated when said first and second track sections are jointly occupied.

12. A control circuit for a warning device used at a multiple track grade crossing and comprising in combination:
   (a) an individual track circuit associated with each of the multiple tracks at the grade crossing;
   (b) individual means associated with each track circuit for responding to the entry of a train within the limits of the track section controlled by the associated track circuit;
   (c) a motion detection unit for selective association with any one of said tracks at said grade crossing; and
   (d) circuit means controlled by said individual means associated with the entered track section for coupling said motion detection unit to the entered track section whereby said motion detection unit can provide signals responsive to the detection of motion on said entered track section.

13. The combination as set forth in claim 12, wherein the control circuit includes means for verifying the ability of the motion detector unit to respond to train motion on the track.

14. The combination as set forth in claim 13, wherein said control circuit responds to a signal from said motion detection unit to actuate the crossing warning device.

15. The combination as set forth in claim 14, wherein said crossing warning device is maintained actuated as long as said motion detection unit detects motion on the track at least once within each successive time frame of predetermined duration.

16. The combination as set forth in claim 15, wherein said motion detection unit is not coupled to any track section when two or more of said individual means responds to entry of a train within the limits of their respective associated track sections.

17. The combination as set forth in claim 16 and including an island track circuit associated with each of the multiple tracks at the grade crossing.

18. The combination as set forth in claim 17 and including island control means associated with each island track circuit and responsive to the entry of a train within the limits of any one of said island track circuits for actuating said crossing warning device.

19. A railroad grade crossing alarm control system comprising in combination:

(a) a single motion detection unit;

(b) a plurality of track circuits each being coupled to a respective track section and with each of said track circuits including means for detecting and responding to the presence of a train on the track and within the limits of the track section monitored by the associated track circuit;

(c) said plurality of track circuits including an island track circuit whose associated track section boundaries extend from at least one side to the other of the grade crossing;

(d) first circuit means associated with each track circuit for initiating activation of the grade crossing alarm in response to the detection of a train by one of said track circuits;

(e) second circuit means responsive to an associated first circuit means for coupling said motion detection unit to the track section associated with the activated first circuit means only when said motion detection unit is not already associated with another track section; and (f) motion detection means included in said motion detection unit for providing a signal to maintain the grade crossing alarm activated if train motion is detected at least once within each successive time frame of predetermined duration.

20. The combination as set forth in claim 19, wherein said island track circuit includes third circuit means for overriding said motion detection means and providing a signal to maintain the grade crossing alarm activated whenever said island track circuit responds to the presence of a train within the limits of the track monitored by the island track circuit.

21. The combination as set forth in claim 20, wherein said track circuits are associated with a single track with one track circuit on each side of the island track circuit.

22. The combination as set forth in claim 21, wherein said motion detection means maintains said grade crossing alarm activated only when the detected train motion is towards the grade crossing.

23. The combination as set forth in claim 21, wherein said control system includes monitor means for verifying the ability of said motion detection unit to respond to train motion.

24. The combination as set forth in claim 20, wherein said grade crossing includes a plurality of tracks.

25. The combination as set forth in claim 24, wherein said second circuit means can couple said motion detection unit to only one of said plurality of tracks at a time.

26. The combination as set forth in claim 25, wherein said grade crossing alarm is activated whenever one of said island track circuits detects the presence of a train and independent of train motion.

* * * * *